United States Patent [19]

Kubitzek et al.

[11] 4,035,464

[45] July 12, 1977

[54] PROCESS FOR THE PRODUCTION OF POLYAMIDE-6 FILAMENT YARNS

[75] Inventors: Harry Kubitzek; Georg Hinrichsen, both of Dormagen; Wolfgang Giessler, Straberg, all of Germany

[73] Assignee: Bayer Aktiengesellschaft, Leverkusen, Germany

[21] Appl. No.: 595,031

[22] Filed: July 11, 1975

[30] Foreign Application Priority Data

July 20, 1974 Germany ..... 2435009

[51] Int. Cl.[2] ..... D02G 1/20

[52] U.S. Cl. ..... 264/103; 28/271; 264/210 F; 264/290 N

[58] Field of Search ..... 264/103, 290 N, 210 F; 28/72.12; 57/157

[56] References Cited

U.S. PATENT DOCUMENTS

| | | | |
|---|---|---|---|
| 3,279,164 | 10/1966 | Breen et al. | 57/157 |
| 3,452,130 | 6/1969 | Pitzl | 264/210 F |
| 3,457,338 | 7/1969 | Lefeuve | 264/210 F |
| 3,529,413 | 9/1970 | Marrinan et al. | 57/140 |
| 3,555,808 | 1/1971 | Gutman | 264/210 F |
| 3,719,442 | 3/1973 | Schippers et al. | 425/72 |
| 3,733,801 | 5/1973 | Jones | 57/157 TS |
| 3,803,282 | 4/1914 | Hamana et al. | 264/103 |

FOREIGN PATENT DOCUMENTS

| | | | |
|---|---|---|---|
| 47-36457 | 9/1972 | Japan | 57/157 TS |

*Primary Examiner*—Jay H. Woo
*Attorney, Agent, or Firm*—Plumley and Tyner

[57] ABSTRACT

The invention relates to a process for the continuous production of a stretched and interlaced polyamide-6 filament yarn wherein the filaments are interlaced before stretching.

3 Claims, 2 Drawing Figures

PROCESS FOR THE PRODUCTION OF POLYAMIDE-6 FILAMENT YARNS

Figure 1:
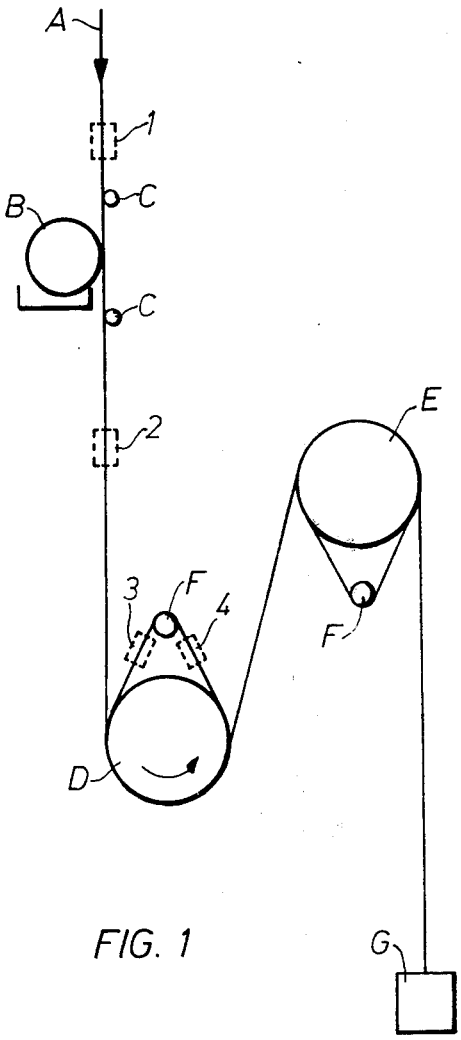

The present invention relates to a process for the continuous production of stretched and interlaced polyamide-6 filament yarns from polyamide-6 melts.

Stretched filament yarns of polycaproamide can be conventionally produced in very good yields in two process stages which are separated from one another both in space and time, namely spinning, generally at speeds of around 1000 to 1200 meters per minute, and drawing on draw-twisting or draw-winding machines. Unfortunately, this process involves very considerable outlay and only gives filament yarns of satisfactory quality when carried out in properly conditioned spinning and drawing rooms.

Another possible method of obtaining stretched polycaproamide filament yarns is to carry out the process stages of spinning and stretching continuously by the socalled spinning and stretching process, whose specific problems have been solved in different ways (see for example, German Patent 1,950,743, U.S. Pat. No. 3,452,130, DAS 1,435,713 and DOS 1,904,234).

The combined spinning and stretching process undoubtedly has some advantages over the conventional two-stage method. Unfortunately, the effectiveness of the combined spinning and stretching of polyamide-6 filament yarns, especially fine-denier filament yarns, at stretching and winding speeds in the range from 3000 to 4000 meters per minute, is seriously restricted by the fact that, to obtain a satisfactory package structure, the filaments have to be treated after stretching at relatively high temperatures above 150° C, whereas conventional spinning and stretching does not involve any such heat treatment, and further by the fact that individual filament breakages during spinning and stretching result in the breakages of all the filaments travelling over one and the same combined spinning, stretching and winding unit. The above-mentioned inadequacies of combined spinning, stretching, and winding processes seriously affect the economy of those processes.

Accordingly, it is the primary object of the present invention to provide a fully continuous combined spinning, stretching and winding process for polyamide-6 filament yarn which operates with low fixing temperatures and guarantees high yields of continuously wound packages, and hence operates economically, and in which the filament yarn can be wound onto winding tubes or twist cops.

It has now been found that this object can be achieved by interlacing (random intermingling) the filaments in a combined spinning and drawing process before they are stretched.

Accordingly, the invention relates to a process for continuously producing stretched and interlaced (randomly comingled) polyamide-6 filament yarns from polyamide-6 melts by extruding the melt through spinnerets, cooling the filaments by blowing air onto them in the spinning duct, wetting the bundle of filaments with an aqueous preparation and running off the filament yarn with a take-off unit around which the filament is looped at least once, followed by direct stretching with a stretching unit and winding into package form, wherein, before stretching, the filament yarn is interlaced in such a way that it has a hook-drop value of at most 200 mm, and wherein the filament yarn is treated after stretching at temperatures above 110° C, and preferably at temperatures of from 115° to 130° C.

The process according to the invention, in which the multifilament yarns are interlaced before stretching, has surprising and unexpected effects by comparison with the identical process in which the multifilament yarns are not interlaced or in which they are interlaced after passing through the drawing zone. In these cases it is only possible to obtain a satisfactory package structure suitable for subsequent further processing if the filament yarns are heat-treated immediately after drawing at temperatures of 150° C and higher, i.e., if in the most simplest the surface of the stretching godet(s) is kept at temperatures above 150° C.

By contrast, a satisfactory package structure is obtained in the process according to the invention, where the multifilament yarns are interlaced before stretching at lower heat-set temperatures, i.e., at temperatures above 110° C and preferably in the range from 115° to 130° C. The fully continuous combined spinning, drawing and winding process according to the invention, in which the multifilament yarns are interlaced before the drawing zone, is further distinguished from the identical processes where the multifilament yarns are not interlaced or where they are interlaced after stretching, by the fact that it increases the yield of continuously wound packages to almost 100%, whereas, in the similar processes mentioned above, the corresponding yield, which is governed to a large extent by the quality of the chips but which is also adversely affected by the high temperatures required in that process, only amounts to between 80 and 95%. It is remarkable that the process according to the invention should give the same or even better snarl counts of less than about 0.1/kg as compared with the similar process referred to above where the multifilament yarns are interlaced after stretching. This is completely surprising because it is a twisted filament yarn, i.e., a filament yarn in which the individual filaments are randomly intermingled or interwoven like a rope, which is stretched in the process according to the invention.

The process according to the invention is further distinguished by one very surprising feature which is also of considerable significance both to its economy and to the suitability of combined spinning and drawing for the production of fine filament yarns on an industrial scale.

As already known, fine filament yarns, if they are to be suitable for use in most textile processing operations, have to have their individual filaments held together either by twisting or interlacing. Now, on the one hand it has not yet proved possible to wind up filament yarns in this form onto cops at the speeds in question here of 3500 to 4000 meters per minute. On the other hand, fine filament yarns produced by one of the above-mentioned similar continuous processes, i.e., processes in which the multifilament yarns are not interlaced or in which they are interlaced after the stretching zone, produce packages with the same favorable structure when wound on winding machines under identical conditions. However, this means that in a process with an interlacing step after stretching, the interlacing, as already mentioned, being necessary for almost every application of the fine filament yarns, there is no noticeable difference between packages which have been wound from interlaced, non-interlaced or only inadequately interlaced filaments, so that in this process the degree of interlacing has to be continuously checked. By contrast, it is only possible in the process according to the invention to obtain packages of favourable structure with good degrees of interlacing at heat-treating temperatures in the range from 110° to 130° C. If the winding conditions are adjusted for example in such a way that, with an interlace count of 10 to 20/meter, as measured by the hookdrop test according to U.S. Pat. No. 2,985,995, all the surfaces of the package are still straight, even in the case of very heavy packages weighing up to 20kg, the package structure is distinctly poorer with interlace counts in the range from 5 to 10/meter, whilst with interlace counts of from 5 to 0/meter it is not possible to wind useful packages at all. Accordingly, the process according to the invention gives a direct indication of interlacing level and, hence, of disturbance in the interlacing operation attributable to operational faults. Since, on the one hand, filament yarns with interlace counts of 5/meter and more can be further processed without additional faults either in their travel or in their quality and since, on the other and, it is not possible in the process according to the invention to achieve useful packages when the interlace count is below 5/meter, there is no need for checking the degree of interlacing in the process of the invention.

It is obvious that the combination of a fully continuous combined spinning and drawing process with an interlacing step preceding the drawing stage can also be applied to filament yarns produced from other starting materials and to fully continuous multistage spinning and drawing processes. In addition, it is obvious that the interlacing stage carried out before stretching may be combined with a preliminary wetting or with a second wetting stage using a preparation or water or an aqueous preparation. In cases where more highly heat-setted filament yarns are required for special applications, this can, of course, be achieved in the process according to the invention by exposing the filament yarns to higher heat-setting temperatures immediately after they have passed through the drawing zone, the reduction in the number of wraps attributable to the interlaced form of the filament yarn enabling higher stretching levels and hence, higher heat-setting temperatures to be applied. Heat does not necessarily have to be supplied by internally heated godets. It may also be supplied from outside, i.e., from external heaters surrounding the stretching unit, or from heating bars.

In principle, the process according to the invention may be carried out with any known textile yarn-jet. As any expert will know, the degree of interlacing of a multifilament yarn is governed by various parameters such as, for example, the dimensions of the yarn-jet, filament tension, air pressure, and finish-on-yarn. One factor above all which is essential to the process according to the invention is that the interlace level referred to above should be reached.

However, any average expert will be able to adjust these levels.

Accordingly, the yarn jet described in the following Example has merely been selected at random, and the invention is by no means limited in its scope to this particular jet.

The process according to the invention is carried out by conventionally spinning polyamide-6 filaments from an extruder, blowing air onto them and, following the application of an aqueous preparation, oil emulsion or solution, passing the filaments over a slowly rotating, cold take-off godet with a guide member or over a pair of cold godets to a pair of heated godets rotating at a higher speed (stretching pair) or to an individual, heated stretching godet with an intermediate roller and then onto a high speed winder, the filaments being interlaced either before the take-off unit or in one of their circuits around the take-off unit. Accordingly, the filament is preferably looped around the take-off unit from 1 to 6 times and around the stretching unit from 3 to 10 times.

FIG. 1 diagrammatically illustrates a few possibilities for carrying out the process according to the invention. In FIG. 1, A is a filament coming from a spinning duct, B is a preparation roller, C is a filament guide, D is the take-off godet at room temperature, E is a heated stretching godet, F indicates intermediate rollers or godets, G is a winding unit, whilst the references 1, 2, 3, and 4 denote possible positions for the interlacing jet.

Figure 2:
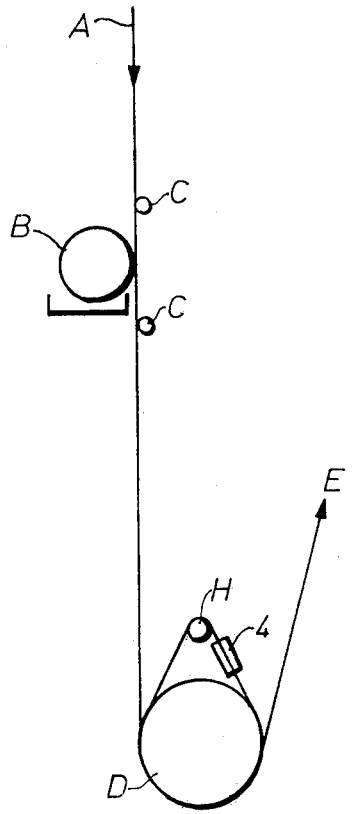

FIG. 2 shows one particularly advantageous embodiment of the process according to the invention, in which the take-off unit consists of a single driven roller D and in which a yarn-jet 4 with a ceramic pin H at its outlet end acts as a guide. The other symbols have the same meaning as in FIG. 1.

The polyamide-6 filament yarns produced by the process described above and illustrated in the drawings have a substantially pure $\gamma$-structure which is characterized in an X-ray photograph by substantially equally intensive meridian and equator reflexes.

Despite their $\gamma$-structure which differs from the $\alpha$-structure of conventionally produced filament yarns, the filament yarns produced by the process according to the invention may be used for any purposes for which the conventionally produced polyamide-6 filament yarns are also used.

The basic principle of the process according to the invention is illustrated in the following Example, although the invention is by no means limited in its scope to this Example.

EXAMPLE

Polyamide-6 granulate with a relative solution viscosity of 2.65 in the form of a 1% solution in m-cresol is melted in a grid head and the resulting melt forced at 280° C through 12-bore spinnerets by means of metering pumps. The bore diameter is 0.25 mm. The ratio between the length of the metering bores to the bore diameter of the spinneret amounts to 2. Air at ambient temperature is blown onto the filaments in the spinning duct, after which the filaments are wetted with an antistatic water-in-oil emulsion below the spinning duct and run off at 1767 meters per minute by means of a godet with an intermediate roller. The filament yarn is looped once around the take-off unit consisting of the unheated godet and transfer roller. At the same time, the filament yarn passes through an interlacing jet operated with air under 6 atms. pressure which is arranged between the godet and the transfer roller and whose filament duct is 20 mm long and 1.5 mm in diameter. Two opposite air inlet openings 0.88 mm in diameter open into the filament duct. The air inlet bores are perpendicular to the filament duct and are situated in the middle of that duct. Immediately afterwards the filament yarn is stretched by a pair of stretching godets rotating at 3800 m/minute and heated to a surface temperature of 120° C. After passing 6 times around the stretching unit, the filament yarn, which is now stretched to a denier of 67 dtex, is wound at 3722 m/minute by means of a friction winder. The uniform, high-volume filament package obtainable in a yield of almost 100% over long spinning times can be warped with snarl counts of less than 0.1/kg. under a uniform take-off tension over the entire width of the package, and further processed into knitted fabrics with an extremely good dye finish. If the tension under which the filament yarn enters the yarn-jet, as measured in the absence of compressed air, amounts to between 6.5 and 7.5 g, the hook-drop value of the twisted filament yarn (according to U.S. Pat. No. 2,985,995) amounts to between 55 and 85 mm.

If, under the conditions mentioned above, the supply of air to the interlacing jet is switched off, or if interlacing is carried out under the same conditions between the stretching pair and the winding unit, it is not possible to obtain useful packages, even by varying the winding speed. Under these conditions, a package of favourable structure is only obtained at stretching pair temperatures above 150° C.

What we claim is:

1. A process for the continuous production of stretched and twisted polyamide-6 filament yarns from polyamide-6 melts by extruding the melt through spinnerets, cooling the filaments by blowing are onto them in the spinning duct, wetting the bundle of filaments with an aqueous preparation and running off the filament yarn with a take-off unit around which the filament yarn passes at least once, followed by direct stretching with a stretching unit and winding into package form, wherein, before stretching, the filament yarn is interlaced in such a way that it has a hook-drop value of at most 200 mm and wherein the filament yarn is treated after stretching at temperature above 110° C.

2. A process as claimed in claim 1, wherein the filament yarn is treated after stretching at temperatures in the range from 115° to 130° C.

3. A process as claimed in claim 1 wherein the hook-drop value is at most 100 mm.

* * * * *